United States Patent [19]

Stoner

[11] Patent Number: 4,688,658

[45] Date of Patent: Aug. 25, 1987

[54] COLLAPSIBLE SUPPORT SYSTEM

[76] Inventor: William F. Stoner, 8401 Peters St., Frederick, Md. 21701

[21] Appl. No.: 769,504

[22] Filed: Aug. 26, 1985

[51] Int. Cl.[4] ..... B27B 21/00

[52] U.S. Cl. ..... 182/153; 182/181; 182/225

[58] Field of Search ..... 182/153, 181–186, 182/224–226, 129, 159, 152; 211/199

[56] References Cited

U.S. PATENT DOCUMENTS

| | | | |
|---|---|---|---|
| 393,210 | 11/1888 | Chapman . | |
| 434,792 | 8/1890 | Kopf | 182/159 |
| 507,131 | 10/1893 | Horrocks . | |
| 564,504 | 7/1896 | Cody . | |
| 619,050 | 2/1899 | Shepherd | 211/199 |
| 1,284,078 | 11/1918 | Evans | 182/152 |
| 1,450,869 | 4/1923 | Reinelt . | |
| 1,943,871 | 1/1934 | Landberg | 182/152 |
| 2,132,988 | 10/1938 | Leibo | 403/95 |
| 2,136,420 | 11/1938 | Edwards . | |
| 2,599,670 | 6/1952 | Thomas | 182/152 |
| 2,994,402 | 8/1961 | Tyler | 182/152 |
| 3,696,887 | 10/1972 | Brzykcy . | |
| 4,030,565 | 6/1977 | Chaput . | |
| 4,534,447 | 8/1985 | Champigny | 182/152 |

*Primary Examiner*—Reinaldo P. Machado
*Attorney, Agent, or Firm*—Fisher, Christen & Sabol

[57] ABSTRACT

This invention includes a collapsible support system having two primary frames and at least one secondary frame. Each secondary frame is hingedly connected to both primary frames. The frames form a collapsible support system selectively convertible between a rigidly box-like operational position and a substantially planar transportable position. This invention also includes a collapsible support system having a rail mounted to each primary frame adapted to hold a disposable board. Carpenter's work pieces can be laid across the collapsible support system.

13 Claims, 7 Drawing Figures

COLLAPSIBLE SUPPORT SYSTEM

BACKGROUND OF THE INVENTION

1. Field of The Invention

This invention relates to collapsible support systems. In particular this invention relates to collapsible support systems which are easily foldable and stackable.

2. Description of The Prior Art

Collapsible support systems such as folding sawhorses and collapsible worktables are commonly known in the art. Collapsible support systems are used widely in the construction industry. Large and small contractors have use for a collapsible support system that can be easily transported from one work place to another and from one job site to another. It is desirable that an easily transportable collapsible support system be stackable. A collapsible support system that can be easily converted to an operable position is also desirable. Few collapsible support systems combine all of these desirable features.

Collapsible support systems in use today have a variety of undesirable features. A complicated procedure is required to convert many collapsible support systems from a collapsed position to an operable position. A complicated procedure increases the time required to convert a collapsible support system between such positions thereby increasing worker inefficiency. Certain collapsible support systems must be disassembled before stacking. A disassembled support system increases the probability of losing parts. Still other foldable systems incorporate parts having scissor action which can be a threat to worker safety.

A collapsible support system of simple construction is more desirable than a collapsible support system of complex construction. A collapsible support system of simple construction has a relatively small number of parts that interact during the transition between a collapsed position and an operable position. Collapsible support systems having numerous interacting parts are more subject to failure than collapsible support systems having fewer interacting parts. A collapsible support system having numerous interacting parts increases the probability that one of these parts can become broken and render the collapsible support system non-functional.

U.S. Pat. No. 393,210 to Chapman discloses a folding sawhorse. This folding horse is especially adapted for paper-hanger's use or other analogous purposes. This sawhorse is designed to be stored vertically and occupy limited vertical space when folded. A folding horse of such design is not adaptable to horizontal stacking. An inability to be stacked decreases the ease of transporting the sawhorse. The brace bars of this invention have a scissor action folding pattern. A scissor action can be a safety hazard to one who is folding or unfolding the sawhorse. One cutting through an object laid across this folding sawhorse can damage the frame members of the sawhorse.

U.S. Pat. No. 507,131 to Horrocks discloses a clamping machine. The clamping machine is useful for clamping panels when doing cabinet work. The clamping machine has a table top adapted to clamp panels supported by a rigid frame. The rigid frame is made from longitudinal timbers connected by cross pieces. The rigid frame is not collapsible, therefore, the clamping machine is not portable.

U.S. Pat. No. 564,504 to Cody discloses a table top supported by a frame. The table top has numerous hinged sections that can be folded one upon another. The frame support is made from foldable boards and metal brace rods. The appartus of this invention can be collapsed and disassembled into boards and metal rods. Assembly and disassembly of this table top require the removal of bolts and nuts, thus necessitating the use of additional tools. The folding of this apparatus is complex and requires the interaction of numerous parts.

U.S. Pat. No. 1,450,869 to Reinelt discloses a traditional carpenter's folding sawhorse. The sawhorse has a pair of A-shaped legs connected to a longitudinal support member. A replaceable two by four board is secured to the longitudinal member to receive a workpiece. This apparatus is folded by first removing the board and then collapsing the legs and the longitudinal support member. The folding procedure requires a number of independent steps. The legs are collapsed by breaking the joints of the transverse braces and disengaging the extremities of the diagonal braces of the legs from the longitudinal member. The longitudinal support member is collapsed by removing a central locking pin from the joint between the two sections of the longitudinal member. The apparatus can be arranged in substantial parallelism when folded. The disposable board must be removed from the longitudinal support member before the sawhorse can be folded. The longitudinal suport member has a scissor action folding pattern that can be a safety hazzard. At least two of these sawhorses must be used in order to provide a table-like support.

U.S. Pat. No. 3,696,887 to Brzykcy discloses a combination sawhorse, scaffold support, and table. This apparatus has a traditional folding sawhorse shape. This foldable sawhorse includes a capping member having studs that fit into a horizontal beam. The cap can be easily replaced if damaged. The cap is held in place by pins engaging bores in the top beam. A pair of these sawhorses must be appropriately spaced and a plurality of planks must be rested on the inverted channels to serve as a scaffold. A pair of these sawhorses must also be used to function as a table. A table top is adapted to rest on the cap of two appropriately spaced sawhorses.

U.S. Pat. No. 2,136,420 to Edwards discloses an example of a pivotably collapsible trestle with angular legs which are braced on all sides and ends. The support members form a rectangular table top that is open in its center. This center space is adapted to receive a plank which forms a bench top for the trestle. This system can be collapsed according to a complicated procedure by unbolting certain portions of various support members. The system is disassembled when collapsed.

U.S. Pat. No. 4,030,565 to Chaput discloses a traditional collapsible sawhorse. The sawhorse is collapsed into a bundle of board-like members. The center board-like member has a handle. The collapsed system can be carried in a manner similar to that of a briefcase. The legs are secured by pivotably movable support brackets. The movable support brackets grip a ridge board when the legs are spread apart. Rods placed between the legs supply suitable compression for the gripping brackets to secure the ridge board. This invention requires a complex folding pattern to convert the rigid sawhorse into a collapsed package. This invention requires two such collapsible sawhorse packages to support an object in a table-like fashion.

The industry lacks a collapsible support system of simple construction that is easily operated, stacked, and transported. The industry lacks a collapsible support system having these characteristics and that requires only one system to form a table-like support for a given job. A collapsible support system having disposable two-by-four boards in direct contact with a work piece is desirable so that one cutting through the work piece laid across the support system does not damage the frame members of the work system. A collapsible support system that does not require disassembly into separate parts decreases the loss of parts when the system is transported.

SUMMARY OF THE INVENTION

Figure 1:
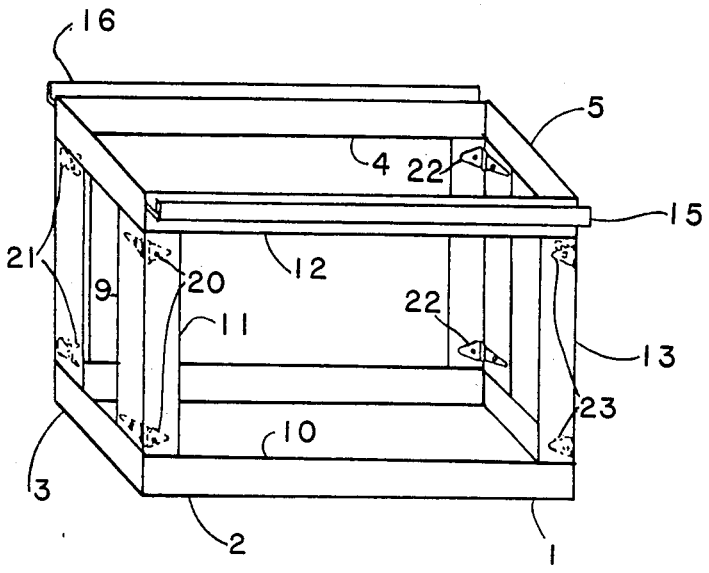
FIG. 1 shows a perspective view of a collapsible support system in an operational position.

The present invention is a collapsible support system having two primary frames and at least one secondary frame. Each secondary frame is hingedly connected to both primary frames. The hingedly connected frames form a collapsible support system selectively convertible between an operational position and a transportable position. The operational position is rigidly box-like. The transportable position is substantially planar.

The present invention also includes a collapsible support system suitable for use as a sawhorse having two primary frames and two secondary frames. Each frame has two vertical members and two horizontal members. A rail is mounted to the upper horizontal member of each primary frame. The mounted rail and horizontal member form a slot adapted to receive and support a disposable board. The mounted rail is positioned such that a disposable board when placed in the rail protrudes above the horizontal member. Each secondary frame is hingedly connected to both primary frames forming a collapsible sawhorse selectively convertible between an operational position and a transportable position. The operational position is rigidly box-like and suitable for supporting a carpenter's workpiece. The transportable position is substantially planar and suitable for stacking with other collapsible support systems.

The preferred embodiment of this invention includes a collapsible support system having rails. The rails can be mounted rigidly or hingedly to the primary frames forming a slot adapted to receive and support a disposable board. The collapsible support system can be used with or without the disposable boards. A hingedly mounted rail is desirably adapted to be folded flush to the primary frame when not in use. The preferred embodiment also includes four frames each frame being a support piece constructed from members.

Alternative embodiments can include a collapsible support system including clamping devices and/or carrying handles. Desirable embodiments include a hinge having a releasable locking mechanism. Wood is the preferred construction material for the collapsible support system of this invention. Metal, plastic, or other suitable materials can also be used to construct this invention. Alternative embodiments can also include a frame that is a single, solid support piece. Frames can have one of a varity of different geometrical shapes including a rectangle or a square. A secondary frame can have multiple units.

DETAILED DESCRIPTION OF THE INVENTION

The present invention is a collapsible support system constructed from two primary frames and at least one secondary frame. The frames are hingedly connected forming a collapsible support system selectively convertible between an operational position and a transportable position. The operational position is rigidly box-like. The transportable position is substantially planar. In the preferred embodiment a rail is mounted to the upper horizontal member of each primary frame forming a slot. The slot is adapted to receive and support a disposable board. The disposable board protrudes above the horizontal member. The collapsible support system can be used with or without the disposable boards. The rail can be rigidly or hingedly mounted to the primary frame. A hingedly mounted rail can be folded flush to the primary frame when not in use. The preferred embodiment includes a frame being a support piece constructed from members. In the preferred embodiment frames are generally rectangular, but can be square or other geometric shapes. Alternative embodiments can include a frame manufactured as a single, solid support piece. Alternative embodiments can also include multiple unit secondary frames. The collapsible support system can be made from one of a variety of different materials including wood, metal, or plastic. The collapsible support system can have clamping devices and/or carrying handles. Desirable embodiments include a collapsible support system having releasable locking mechanisms to secure the collapsible support system in the operational position.

FIG. 1 illustrates the preferred embodiment of a collapsible support system 1 in the operational position. The collapsible support system 1 when in the operational position is rigidly box-like. The box-like configuration of FIG. 1 resembles a cube. The rigidly box-like collapsible support system 1 is stiff and inflexible. This stiff, inflexible structure is strong enough to support workpieces placed upon it.

The collapsible support system 1 can be constructed from two primary frames and at least one secondary frame. The preferred embodiment is constructed from four frames. FIG. 1 illustrates primary frames 2 and 4 hingedly connected to secondary frames 3 and 5. The collapsible support system 1 of the preferred embodiment when in the operational position measures about 40 inches long by about 32 inches high by about 24 inches wide. Any suitable dimensions, that permit a worker to use the collapsible support system to support a work piece, can be used in the design of this invention.

A frame is a support piece of the collapsible support system. The frame typically has a substantially planar shape. A frame can be constructed from members or a frame can be constructed from a single, solid support piece. A single, solid support piece is a single sheet of material. Frames constructed from members are generally lighter than frames constructed from single, solid support pieces. A frame constructed from members is illustrated in FIG. 1. The members 10, 11, 12, and 13 are joined at their ends forming primary frame 2. Primary frame 2 has a port or opening through its center that is bordered by the members 10, 11, 12, and 13. A rectangular board is an example of a member. Objects similar to rectangular boards can also function as members. The members 10 and 12 are horizontal when the primary frame 2 is in an operational position. The members 11 and 13 are vertical when the primary frame 2 is in an operational position. In FIG. 1 a rail 15 is mounted to the member 12 of the primary frame 2. A rail 16 is mounted to the primary frame 4 in similar fashion. All four frames of the preferred embodiment are hingedly connected in like manner.

FIG. 1 shows the first primary frame 2, the second primary frame 4, the first secondary frame 3, and the second secondary frame 5 of the collapsible support system 1. Each frame has a first vertical member and a second vertical member. A first vertical member 11 of the first primary frame 2 is connected by a hinge 20 to a first vertical member 9 of the first secondary frame 3. All frames are hingedly connected in like fashion. The first secondary frame 3 is hingedly connected to the second primary frame 4. The second primary frame 4 is hingedly connected to the second secondary frame 5. The second secondary frame 5 is hingedly connected to the first primary frame 2.

Any hinge means known in the art is suitable for this invention. In FIG. 1 two hinges 20 connect primary frame 2 to secondary frame 3. Two hinges are shown for illustrative purposes only. This invention is not limited by the number, size, or placement of hinges connecting one frame to another frame. A single hinge can cover the entire vertical length of a member.

Figure 2:
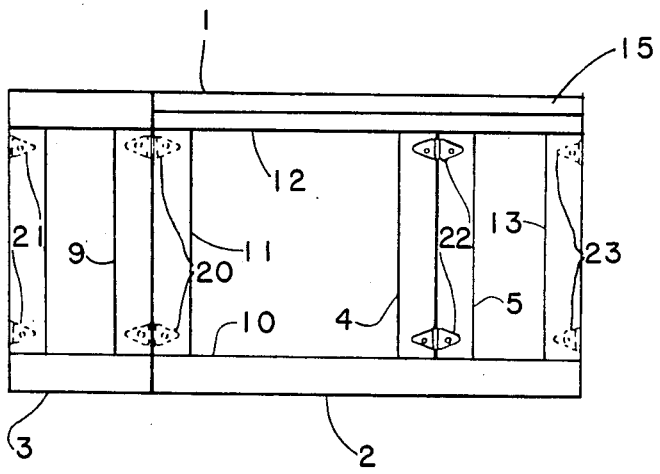
FIG. 2 shows a front plan view of a collapsible support system in the transportable position.

FIG. 2 illustrates a front plan view of the collapsible support system 1 in the transportable position. In this position the four frames of the collapsible support system 1 form two parallel and substantially planar pieces. In FIG. 2 one piece is formed by primary frame 2 and secondary frame 3 and the other piece is formed by primary frame 4 and secondary frame 5. The two substantially planar pieces are in contact and flush against each other. The collapsible support system 1 in the transportable position is substantially planar and lies flat. The preferred embodiment when collapsed measures about 60 inches long by about 32 inches wide by about 9½ inches high. This planar shape enables the collapsible support system 1 to be stacked when laid flat with other collapsible support systems. The collapsible support system can be carried by hooking one's arm through the ports of the frames. Members can be used as carrying handles or have handles fastened to them.

The collapsible support system 1 is selectively convertible between an operational position and a transportable position. The collapsible support system 1 can be converted from one position to another position without disassembling parts. The conversion is quick, easy. The structure of the collapsible support system 1 does not require disassembly and, thereby, eliminates the possibility of losing parts. Also, the structure of the collapsible support system 1 has no scissor action by any of its elements when it is collapsed.

The hinges operate such that the collapsible support system 1 can be converted from one position to another position in a number of different directions. In the preferred embodiment illustrated in FIG. 2 has a hinge 22 connecting the primary frame 4 and the secondary frame 5. The hinge 23 extends and enables primary frame 4 and the secondary frame 5 to form a substantially planar piece. Similarly the hinge 20 extends enabling the primary frame 2 and the secondary frame 3 to form another substantially planar piece. A hinge 23 connecting the primary frame 2 and the secondary frame 5 and a hinge 21 connecting the primary frame 4 and the secondary frame 3 fold enabling the two substantially planar pieces to contact flush against each other. Alternatively the frames 3 and 4 can form a substantially planar piece contacting the substantially planar piece formed by the frames 2 and 5. Folded in either direction the collapsible support system 1 is folded correctly.

The collapsible support system according to this invention must be properly jigged during construction. The hinges must be mounted when the frames are properly jigged to enable the collapsible support system to function correctly. When the frames are properly jigged, the hinges connecting two frames have a common longitudinal properly jigged frames fold on top of one another and are flush with one another when the collapsible support system is converted to the transportable position. Properly jigged frames permit the hinges to operate without binding.

Figure 3:
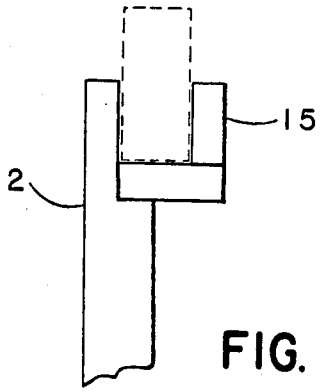
FIG. 3 shows a side plan view of an L-shaped rail mounted to an upper horizontal member of a primary frame supporting a disposable board.

FIG. 3 illustrates a rail 15 rigidly mounted to the cupper horizontal member 12 of the primary frame 2. In the preferred embodiment the rails are L-shaped. A rail 16 is mounted to the primary frame 4. The rail 15 forms a slot or U-shaped trough along the length of primary frame 2. The slot is adapted to hold and support disposable boards. A disposable board is illustrated by phantom lines in FIG. 3. A board such as a wooden two-by-four is suitable for use as a disposable board. The rail 15 is substantially parallel to the primary frame 2. The uppermost surface of the rail 15 and the uppermost surface of the primary frame 2 are coplanar. This design enables the collapsible support system 1 to function in the operational position with or without a disposable board. The collapsible support system can be converted from an operational position to a transportation position with the disposable boards in place. When a disposable board is not used the frame alone is the stress bearing support of a work piece. When a disposable board is used the board protrudes above the upper surfaces of both the rail and the frame. Disposable two-by-four boards placed in the slot enable one cutting through a work piece laid across the collapsible support system to avoid damaging the upper frame members.

Figure 4:
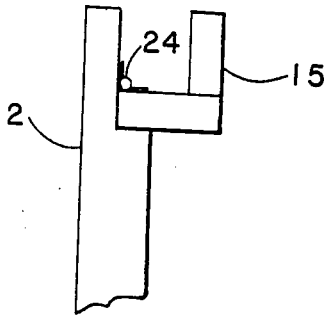
FIG. 4 shows a side plan view of an L-shaped rail hingedly mounted to an upper horizontal member of a primary frame.
Figure 4A:
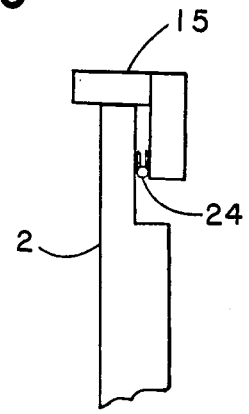
FIG. 4*a* shows a side plan view of the hingedly mounted L-shaped rail of FIG. 4 when folded flush to the upper horizontal member of the primary frame.

FIGS. 4 and **4*a* illustrate the operation of a hingedly mounted rail. FIG. 4 illustrates the rail 15 mounted by a hinge 24 to the primary frame 2 in an open position adapted to receive and support a disposable board. FIG. 4*a* illustrates the rail 15 folded to the primary frame 2 in a colsed position. The hinge 24 can be recessed into the primary frame so as to form a smooth surface with the primary frame when the rail is in the closed position. The rail 15 can be folded in the closed position against the primary frame 2** so as to avoid being damaged during transportation and storage. A folded rail permits easy stacking of collapsible support systems.

The collapsible supporting system can be made from one of a variety of different materials such as wood, metal, or plastic. Wood is the construction material of the preferred embodiment. Any material that is relatively inflexible is suitable for the present invention. The material must be sturdy and enable the collapsible system, when in the operational position, to form a rigid box-like support. The box-like support must be able to withstand the stress exerted by one working on a workpiece laid across the collapsible support system.

Frames according to the present invention can be any geometrical shape. In the preferred embodiment the frames 2, 3, 4, and 5 are rectangularly shaped. The primary frames 2 and 4 are longer than the secondary frames 3 and 5. The most commercially desirable frame shapes are rectangular and square. It is possible to construct a collapsible support system using frames of one or more various geometrical shape. The chosen shape of the frames must allow for the hinges to be connected and must provide for stable of a work piece when the collapsible support system is in the operational position.

Alternative embodiments of this invention can include a frame that is a single, solid planar support piece not having a port or opening framed by members. Additionally, collapsible support systems can have one or more carrying handles fastened to them. Carrying handles can be attached to an outside face of the frame or member of a frame.

Alternative embodiments can also include a collapsible support system utilizing hinges having releasable locking mechanisms. The releasable locking mechanisms enable the hinges to secure the collapsible support system in the operational position.

Alternative embodiments can include clamping devices removably attached to the frames. Clamping devices are known in the art and generally include devices that securely hold workpieces to the frame.

Figure 5:
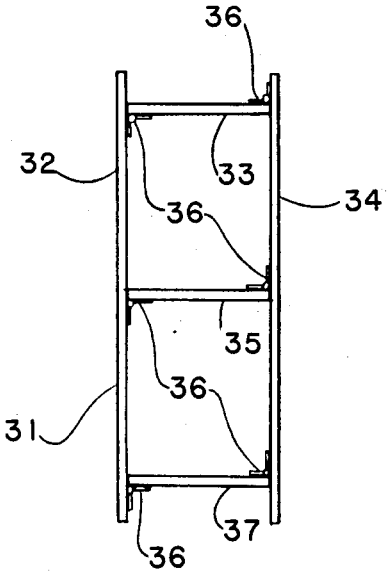
FIG. 5 shows a top plan view of a collapsible support system in the operational position having three secondary frames.

A collapsible support system can be constructed having two primary frames and one or more secondary frames. In FIG. 5 a collapsible support system 31 has three secondary frames 33, 35, and 37. The secondary frames 33, 35, and 37 are connected to primary frames 32 and 34 by hinges 36. FIG. 5 further illustrates the design of a collapsible support system 31 where the secondary frames 33, 35, and 37 are not mounted to the ends of the primary frames 32 and 34. The alternative embodiment of FIG. 5 can be utilized when a more rigid support system capable of supporting heavy work pieces is necessary. According to this design the length of a secondary frame must be shorter than the mounting diatance on the primary frames between secondary frames. This design requirement enables the collapsible support system 31 to be selectively convertible between the operational position and the transportable position without the secondary frames overlapping one another.

Figure 6:
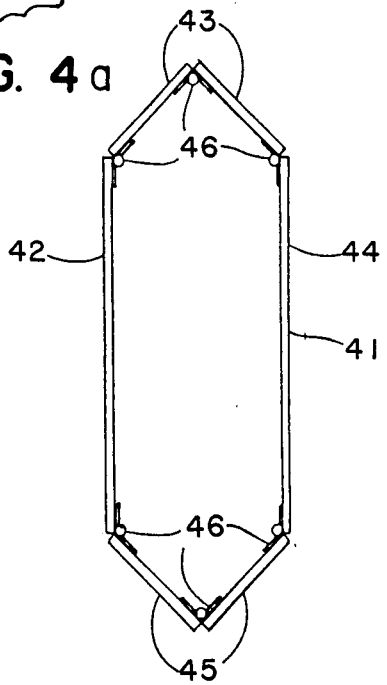
FIG. 6 shows a top plan view of a collapsible support system in the operational position having multiple unit secondary frames.

FIG. 6 illustrates a collapsible support system 41 having multiple unit secondary frames 43 and 45. In FIG. 6 multiple unit secondary frames 43 and 45 each have two units connected by hinges 46. Multiple unit secondary frames can have a plurality of units.

A collapsible support system can function as a traditional collapsible sawhorse. The present invention can support a variety of carpenter's workpieces such as planks, boards, and other pieces of lumber. These workpieces, when laid across the collapsible support system, can be hammered, sawed, sanded, or otherwise handled. Two traditional sawhorses are neded to support a workpiece. Only one collapsible support system according to the present invention is needed to support a work piece.

Alternative uses of the present invention can include a support table. A planar board can be placed across the top of a collapsible support system forming a table. The present invention functions as a table base. The table can support items such as workpieces, blueprints, construction plans, and/or other objects.

What is claimed is:

1. A collapsible sawhorse comprising:

(a) two substantially planar primary frames each primary frame having:
  (i) two vertical members, and
  (ii) two horizontal members;

(b) two substantially planar secondary frames each secondary frame having:
  (i) two vertical members, and
  (ii) two horizontal members;
  wherein a first one of said two vertical members of a first primary frame is hingedly connected to a first one of said two vertical members of a first secondary frame;
  a second one of said two vertical members of said first secondary frame is hingedly connected to a first one of said two vertical members of a second primary frame;
  a second one of said two vertical members of said second primary frame is hingedly connected to a first one of said two vertical members of a second secondary frame;
  a second one of said two vertical members of said second secondary frame is hingedly connected to a second one of said two vertical members of said first primary frame
  said hingedly connected frames forming a collapsible sawhorse selectively convertible between an operational position and a transportable positon, said operational position being rigidly box-like and said transportable position being substantially planar;

(c) two rails, each rail being mounted to an upper horizontal member of said primary frame, when said collapsible sawhorse is in an operational position, to form a slot, said slot being adapted to receive and support a disposable board.

2. A collapsible support system comprising: two primary frames; at least one secondary frame, each said secondary frame being hingedly connected to both said primary frames forming a collapsible support system selectively convertible between an opertional position and a transportable position whereby said operational position is rigidly box-like and whereby said transportable position is substantially planar;

a rail mounted to said primary frame, whereby said mounted rail and said primary frame form a slot adapted to receive and support a disposable board; and an uppermost surface of said primary frame, when in an operational position, and an uppermost surface of said mounted rail are coplanar, said disposable board being supported to protrude above the plane formed by said uppermost surface of said primary frame and said mounted rail.

3. A collapsible support system according to claim 2, wherein said rail is hingedly mounted to said primary frame said hingedly mounted rail being adapted to be selectively fold flush with said primary frame.

4. A collapsible support system according to claim 3, wherein said frame is a solid, substantially planar support piece.

5. A collapsible support system according to claim 3, wherein said frame is a support piece constructed from a plurality of members.

6. A collapsible support system according to claim 5, wherein said at least one secondary frame is a multiple unit frame.

7. A collapsible support system according to claim 5, wherein said collapsible support system is made of wood.

8. A collapsible support system according to claim 5, wherein said collapsible support system is made of metal.

9. A collapsible support system according to claim 5, wherein said collapsible support system is made of plastic.

10. A collapsible support system according to claim 7, wherein said collapsible support system has a releasable locking mechanism adapted to selectively secure said collapsible support system in said operational position.

11. A collapsible sawhorse comprising:

(a) two substantially planar primary frames each primary frame having:

(i) two vertical members, and (ii) two horizontal members;

(b) two substantially planar secondary frames each secondary frame having:

(i) two vertical members, and (ii) two horizontal members;

(c) two rails each rail being mounted, when said sawhorse is in an operational position, to an upper horizontal member of said primary frame;

whereby said upper horizontal member and said mounted rail form a slot adapted to receive and support a disposable board whereby an uppermost surface of said upper horizontal member and an uppermost surface of said mounted rail are coplanar and said disposable board protrudes above the plane formed by said uppermost surfaces of said upper horizontal member and said mounted rail;

each said secondary frame being hingedly connected at said vertical member to one of said primary frames whereby said collapsible sawhorse is selectively convertible between an operational position and a transportable position, said operational position being rigidly box-like and suitable for supporting a workpiece and said transportable position being substantially planar and suitable for stacking.

12. A collapsible sawhorse according to claim 11, wherein said frame is a substantially planar support piece.

13. A collapsible sawhorse according to claim 11, wherein said rail is hingedly mounted to said upper horizontal member, said hingedly mounted rail being adapted to selectively fold flush with said upper horizontal member.

* * * * *